US009701493B2

(12) United States Patent
Sato

(10) Patent No.: US 9,701,493 B2
(45) Date of Patent: Jul. 11, 2017

(54) PAPER FEED TRAY

(71) Applicant: Konica Minolta, Inc., Tokyo (JP)

(72) Inventor: Ryuji Sato, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/753,635

(22) Filed: Jun. 29, 2015

(65) Prior Publication Data

US 2016/0001995 A1 Jan. 7, 2016

(30) Foreign Application Priority Data

Jul. 2, 2014 (JP) ..... 2014-136561

(51) Int. Cl.
*B65H 1/04* (2006.01)
*B65H 1/26* (2006.01)

(52) U.S. Cl.
CPC ..... *B65H 1/04* (2013.01); *B65H 1/266* (2013.01); *B65H 2301/4222* (2013.01);
(Continued)

(58) Field of Classification Search
CPC ... B65H 1/00; B65H 1/04; B65H 1/26; B65H 1/266; B65H 2301/4222; B65H 2405/10;
(Continued)

(56) References Cited

U.S. PATENT DOCUMENTS 7,607,657 B2 * 10/2009 Kawarago ..... B65H 1/266 271/171
8,052,141 B2 * 11/2011 Yamagishi ..... B65H 1/266 271/171

(Continued)

FOREIGN PATENT DOCUMENTS

JP 20007162 A 11/2000
JP 2005177710 A 7/2005
JP 20097162 A 1/2009

OTHER PUBLICATIONS

Office Action dated Sep. 5, 2016 from corresponding Chinese Application; Application No. 201510378944.7; English translation of Office Action; Total of 14 pages.

(Continued)

*Primary Examiner* — Ernesto Suarez
(74) *Attorney, Agent, or Firm* — Lucas & Mercanti, LLP

(57) ABSTRACT

A paper feed tray includes: a tray main body which holds a sheet such that the sheet can be fed in a predetermined paper feed direction; and a regulation plate which can be moved in a side direction perpendicular to the paper feed direction and which regulates the position of the held sheet in the side direction. In the tray main body, a first engagement tooth row and a second engagement tooth row whose engagement teeth are aligned in the side direction are provided so as to be opposite each other, and the first engagement tooth row is higher than the second engagement tooth row. In the regulation plate, an engagement member is provided which can be moved in the direction of height of the engagement tooth rows and which engages with the engagement tooth rows to reduce the movement of the regulation plate in the side direction.

12 Claims, 4 Drawing Sheets

(52) U.S. Cl.
CPC .... *B65H 2402/64* (2013.01); *B65H 2403/411* (2013.01); *B65H 2405/114* (2013.01); *B65H 2405/121* (2013.01); *B65H 2511/12* (2013.01); *B65H 2511/22* (2013.01)

(58) Field of Classification Search
CPC ..... B65H 2405/11; B65H 2405/114; B65H 2405/1142; B65H 2405/12; B65H 2405/121
USPC ..... 271/171
See application file for complete search history.

(56) References Cited

U.S. PATENT DOCUMENTS 8,113,506 B2 * 2/2012 Kaseda ..... B65H 1/266 271/145
8,882,377 B2 * 11/2014 Kim ..... B65H 1/266 271/171
9,027,920 B2 * 5/2015 Sato ..... B65H 1/04 271/171
9,260,262 B2 * 2/2016 Matsumoto ..... B65H 1/266
9,290,339 B2 * 3/2016 Fukunaga ..... B65H 1/04
9,580,258 B1 * 2/2017 McFarland ..... B65H 1/04
2015/0023710 A1 * 1/2015 Yuasa ..... G03G 15/6502 399/393
2015/0298921 A1 * 10/2015 Ishikura ..... B65H 1/04 271/264

OTHER PUBLICATIONS

Notification of Reasons for Refusal issued Mar. 24, 2016; Patent Application No. 2014-136561; Drafting Date: Mar. 15, 2016; Total of 2 pages; English translation of Notification of Reasons for Refusal; Total of 3 pages; Grand Total of 5 pages.

* cited by examiner

PAPER FEED TRAY

This application is based on Japanese Patent Application No. 2014-136561 filed on Jul. 2, 2014, the contents of which are hereby incorporated by reference.

BACKGROUND OF THE INVENTION

Field of the Invention

The present invention relates to a paper feed tray that is used in an image forming apparatus or the like.

Description of the Related Art

Conventionally, in image forming apparatuses such as a printer and a copying machine, a cassette-type paper feed tray is widely used. In such a paper feed tray, a side regulation plate for regulating the position of a sheet in a side direction is provided. In general, the position of the side regulation plate in the side direction can be adjusted.

As a method for fixing the position of the side regulation plate, for example, there is a method of engaging a locking member provided in the side regulation plate with a rack provided in a tray main body. By this method, the position of the side regulation plate can be adjusted with accuracy corresponding to the pitch of rack teeth. However, in this case, the paper feed tray is relatively vulnerable to shock, and for example, when the paper feed tray is swiftly fitted to an image forming apparatus main body, a tooth is skipped by its shock, and the position of the side regulation plate is displaced, with the result that the sheet is skewed.

As a method that is highly resistant to shock, there is a method of previously boring holes corresponding to a standard-sized sheet in a paper feed tray main body and utilizing the holes and another member to firmly fix the side regulation plate. However, by this method, it is impossible to firmly lock the side regulation plate in a position corresponding to an irregular-sized sheet, and the number of components is also increased, with the result that the cost is disadvantageously increased.

For example, Japanese Unexamined Patent Application Publication No. 2005-177710 proposes a method of providing a pair of engagement tooth rows in the paper feed tray main body and engaging a member on the side of the side regulation plate with these engagement tooth rows. By this method, a locking force for fixing the position of the side regulation plate is increased, and it is possible to lock the side regulation plate in a position corresponding to an irregular-sized sheet.

However, in the method of providing the pair of engagement tooth rows, in order to engage the member with both the engagement tooth rows, a high operation force such as for making phase differences coincide with each other is required. Hence, two-stage switching between cancellation and locking is needed, and in a cancellation state, the paper feed tray is more likely to be fitted because a user fails to perform a locking operation. In this case, disadvantageously, the side regulation plate is extremely easily moved.

When the locking is cancelled, and the side regulation plate is moved, a hand switching operation is needed between the operation of cancelling the locking and the operation of moving the side regulation plate. In terms of convenience, it is desirable to be able to omit such an operation.

In view of the foregoing problems, the present invention has an object to provide a paper feed tray with which it is possible to perform firm locking and it is easy to, for example, avoid a failure caused by failing to perform a locking operation.

SUMMARY OF THE INVENTION

A paper feed tray according to the present invention includes: a tray main body which holds a sheet such that the sheet can be fed in a predetermined paper feed direction; and a regulation plate which can be moved in a side direction perpendicular to the paper feed direction and which regulates a position of the held sheet in the side direction, where in the tray main body, a first engagement tooth row and a second engagement tooth row whose engagement teeth are aligned in the side direction are provided so as to be opposite each other, in the regulation plate, an engagement member is provided which can be moved in a direction of height of the engagement tooth rows and which engages with the engagement tooth rows to reduce the movement of the regulation plate in the side direction and the first engagement tooth row is higher than the second engagement tooth row.

Preferably, in the configuration described above, the engagement member can be moved into: a locking position in which the engagement member engages with both the first engagement tooth row and the second engagement tooth row; a cancellation position in which the engagement member engages neither with the first engagement tooth row nor the second engagement tooth row; and a semi-locking position in which the engagement member engages with the first engagement tooth row but does not engage with the second engagement tooth row.

Preferably, in the configuration described above, in the regulation plate, a rotation member supported such that the rotation member can be rotated about an axis which is the side direction is provided, the engagement member is formed so as to be moved in the direction of the height coordinately with the rotation of the rotation member and the rotation member can be rotated into: a first rotation position in which a position of the engagement member is the semi-locking position; a second rotation position in which the position of the engagement member is the cancellation position; and a third rotation position in which position of the engagement member is the locking position.

Preferably, in the configuration described above, more specifically, a force acting in a direction from the second rotation position toward the first rotation position is applied to the rotation member.

Preferably, in the configuration described above, the rotation member includes a protrusion which protrudes toward the regulation plate and which has elasticity, the rotation member includes a first hole which prevents interference with the protrusion when the rotation member is rotated between the first rotation position and the second rotation position and a second hole which prevents interference with the protrusion when the rotation member is in the third rotation position and the protrusion interferers with the regulation plate when the rotation member is rotated between the first rotation position and the third rotation position.

Preferably, in the configuration described above, more specifically, the first engagement tooth row is arranged closer to a pivot of the rotation than the second engagement tooth row.

DESCRIPTION OF PREFERRED EMBODIMENTS

An embodiment of the present invention will be described below with reference to drawings.

Figure 1:
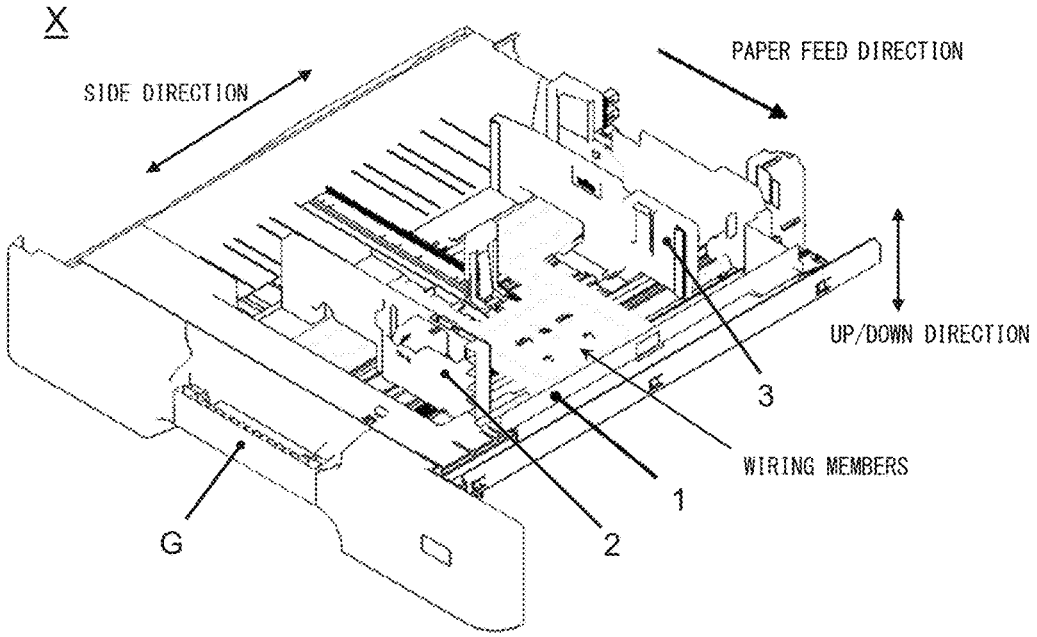
FIG. 1 An overall perspective view of a paper feed tray according to the present embodiment.
Figure 2:
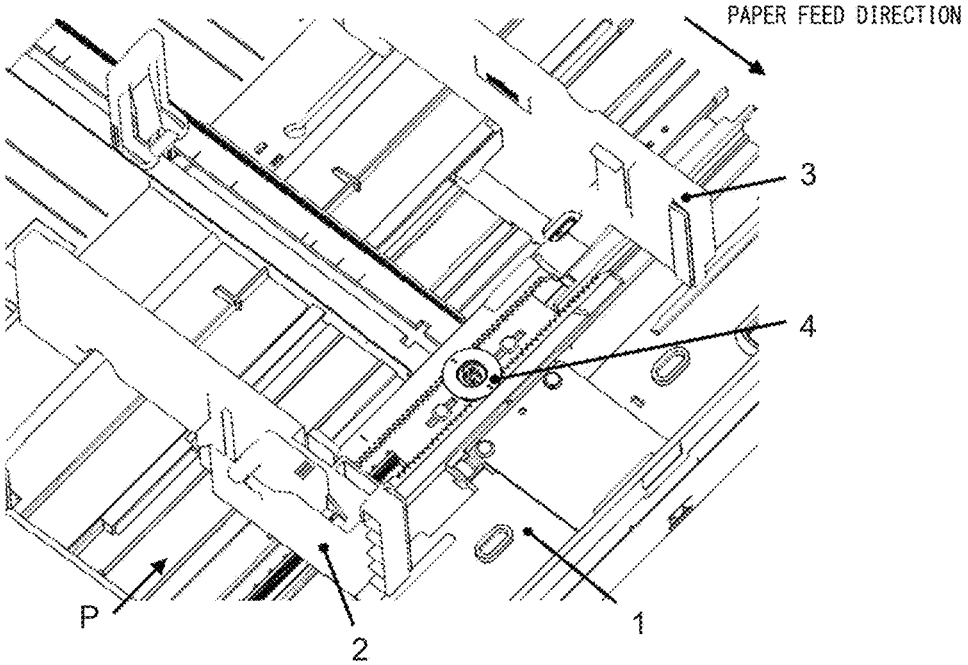
FIG. 2 A detailed perspective view of a main part of the paper feed tray.

FIG. 1 is an overall perspective view of a paper feed tray X according to the present embodiment. FIG. 2 is a detailed perspective view of a main part of the paper feed tray X. In FIG. 2, the display of wiring members shown in FIG. 1 is omitted with consideration given to ease of viewability.

As shown in these figures, the paper feed tray X includes a cassette-type paper feed tray main body 1 (hereinafter also referred to as a "cassette 1"), a pair of side regulation plates (a side regulation plate 2 on the front side and a side regulation plate 3 on the far side), a pinion gear 4 and a handle G. In the following description, a paper feed direction, a side direction (perpendicular to the paper feed direction) and an up/down direction are as shown in FIG. 1. With respect to the side direction, in FIG. 1, a lower left direction is the front side (close to a user), and an upper right direction is the far side.

The paper feed tray X is removable with respect to an unillustrated image forming apparatus main body. The user holds the handle G, thereby can move the paper feed tray X freely in the side direction and can perform, for example, the supply of sheets. The paper feed tray X can supply the sheet in the paper feed direction while being fitted to the image forming apparatus main body.

The cassette 1 is formed to hold the sheet such that the cassette 1 can feed the sheet in the paper feed direction. The cassette 1 holds a large number of sheet stacked in the up/down direction, and can supply the sheets sequentially from the upper side to the image forming apparatus main body.

The pair of side regulation plates 2 and 3 can be moved in the side direction, and regulate the position of the sheets held in the cassette 1 in the side direction. The pinion gear 4 is arranged so as to connect these side regulation plates 2 and 3.

Specifically, the pinion gear 4 is interposed between a rack connected to the side regulation plate 2 on the front side and a rack connected to the side regulation plate 2 on the far side, and thereby forms a rack-and-pinion mechanism. In this way, when the user moves the side regulation plate 2 on the font side in the side direction, the side regulation plate 3 on the far side is moved in the opposite direction by the same amount.

Figure 3:
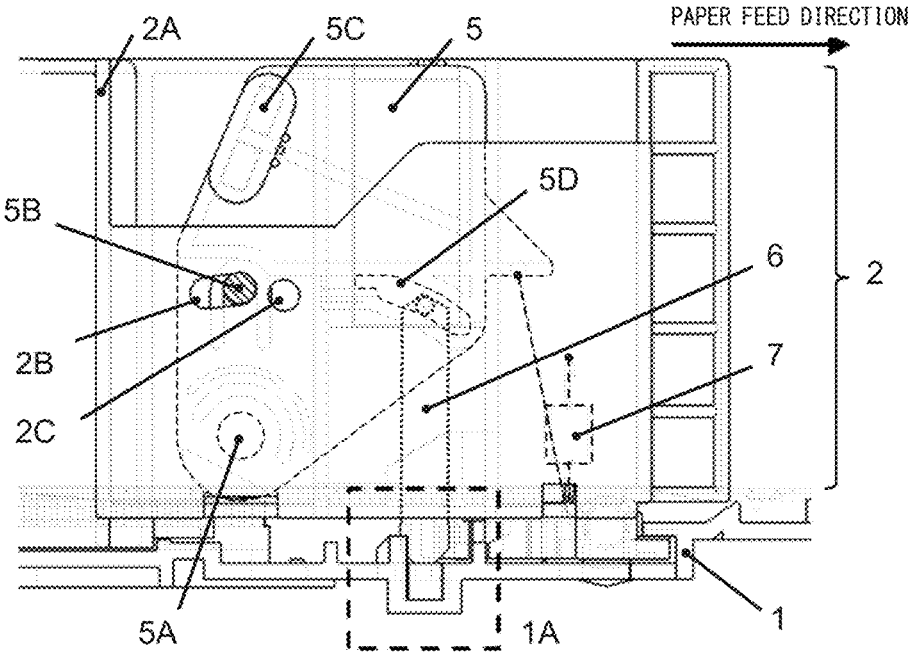
FIG. 3 A diagram showing the configuration of a cassette and a side regulation plate according to the present embodiment.
Figure 4:
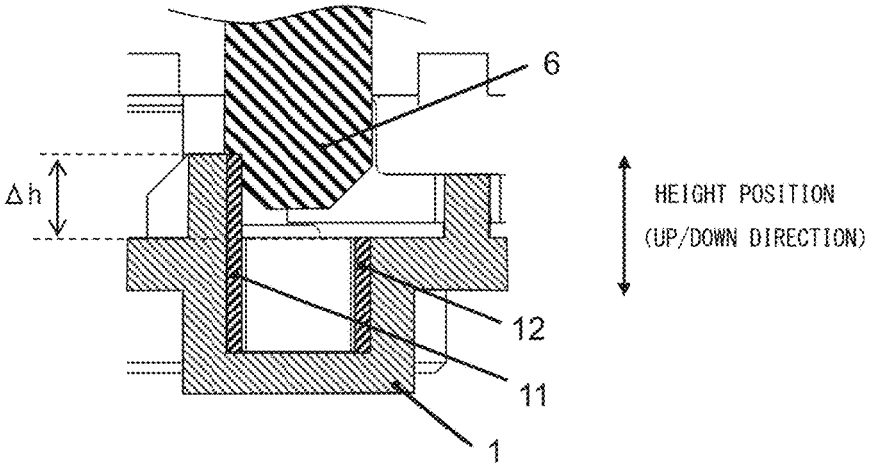
FIG. 4 An illustrative diagram of a latch engagement portion according to the present embodiment.
Figure 5:
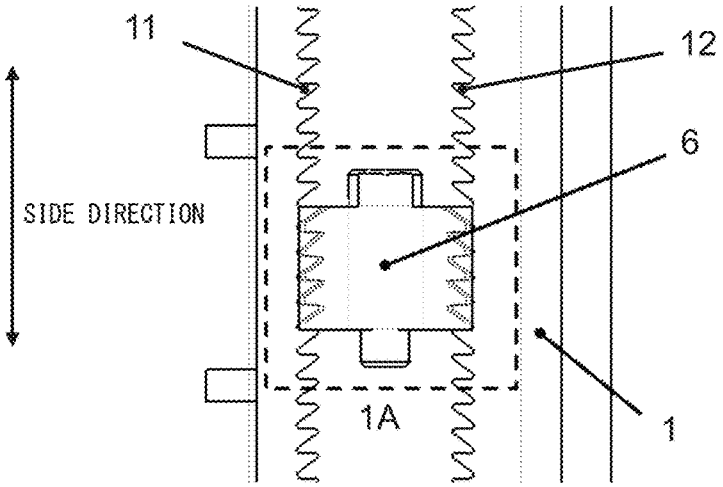
FIG. 5 An illustrative diagram when the latch engagement portion is seen from the upper side.

The configuration and the like of the cassette 1 and the side regulation plate 2 will then be described in more detail. FIG. 3 shows the configuration (arrow view) of the cassette 1 and the side regulation plate 2 when seen in a direction indicated by P in FIG. 2. FIG. 4 is a detailed view of a latch engagement portion 1A shown in FIG. 3, and FIG. 5 is a diagram when the latch engagement portion 1A is seen from the upper side.

As shown in the figures, the cassette 1 includes a first engagement tooth row 11 and a second engagement tooth row 12. In each of these engagement tooth rows, engagement teeth are aligned in the side direction, and the first engagement tooth row 11 and the second engagement tooth row 12 are provided so as to be opposite each other. These engagement tooth rows can be regarded as a pair of racks opposite each other.

As shown in FIG. 4, the height of the first engagement tooth row 11 is higher than that of the second engagement tooth row 12 by Δh. In other words, the upper end of the first engagement tooth row 11 protrudes from the upper end of the second engagement tooth row 12 by Δh.

The side regulation plate 2 includes an operation portion 2A, a first through hole 2B, a second through hole 2C, an operation lever 5, a lock lever 6 and a spring 7. The operation portion 2A is a portion that is utilized for an operation of the user together with an operation portion 5C, and protrudes slightly from the surface of the side regulation plate 2 to the front side. The first through hole 2B and the second through hole 2C are holes (notches) that are provided so as to pass through the side regulation plate 2.

The operation lever 5 includes a rotation pivot 5A, a protrusion 5B, the operation portion 5C and a notch 5D, and is a member (rotation member) which is supported such that it can be rotated about an axis that is the side direction. The rotation pivot 5A is a portion that is supported by the side regulation plate 2 and is a pivot of the rotation. The protrusion 5B is a protrusion that protrudes toward the side regulation plate 2 and that has elasticity. The protrusion 5B protrudes so as to be fitted into the first through hole 2B or the second through hole 2C on the side of the side regulation plate 2.

The operation portion 5C is arranged near the operation portion 2A, and protrudes slightly to the front side as with the operation portion 2A. Hence, the user easily holds the operation portion 2A and the operation portion 5C so as to sandwich them. The notch 5D coordinates with the upper-side tip end of the lock lever 6, and thus the upper-side tip end can be moved within the notch 5D. The shape of the notch 5D is set such that the lock lever 6 is moved substantially in the up/down direction (the direction of the height of the engagement tooth rows described above) coordinately with the rotation of the operation lever 5.

As described above, the lock lever 6 can be moved in the direction of the height of the engagement tooth rows 11 and 12. The lower-side tip end portion of the lock lever 6 is shaped to engage with the teeth of the engagement tooth rows 11 and 12. In this way, the lock lever 6 engages with at least one of the engagement tooth rows (makes a latch engagement by engaging therewith), and thus the movement of the side regulation plate 2 in the side direction is reduced.

The lock lever 6 can be moved into: a locking position (see FIG. 7) in which the lock lever 6 engages with both the first engagement tooth row 11 and the second engagement tooth row 12; a cancellation position (see FIG. 6) in which the lock lever 6 engages neither with the first engagement tooth row 11 nor with the second engagement tooth row 12 and a semi-locking position (see FIG. 3) in which the lock lever 6 engages with the first engagement tooth row 11 but does not engage with the second engagement tooth row 12.

One end of the spring 7 is connected to the side regulation plate 2, the other end is connected to the operation lever 5 and the spring 7 applies a force acting in one rotation direction (clockwise direction in FIG. 3) to the operation lever 5.

The operation lever 5 can be rotated into: a first rotation position in which the position of the lock lever 6 is the semi-locking position; a second rotation position in which the position of the lock lever 6 is the cancellation position; and a third rotation position in which the position of the lock lever 6 is the locking position.

The first through hole 2B described previously is formed in the shape of a path along which the protrusion 5B is passed when the operation lever 5 is rotated between the first rotation position and the second rotation position, and is provided so as to prevent the side regulation plate 2 from interfering with the protrusion 5B. When the operation lever 5 is rotated between the first rotation position and the second rotation position, the operation lever 5 is rotated along the first through hole 2B.

The second through hole 2C is shaped (in the present embodiment, is formed substantially in the shape of a true circle) so as to correspond to the shape of the tip end of the protrusion 5B. The second through hole 2C is provided such that, when the operation lever 5 is in the third rotation position, the protrusion 5B is fitted into the second through hole 2C to prevent the side regulation plate 2 from interfering with the protrusion 5B.

The first through hole 2B and the second through hole 2C are not continuous. Hence, when the operation lever 5 is rotated between the first rotation position and the third rotation position, the protrusion 5B interferes with the side regulation plate 2.

The first to third rotation positions will then be described in more detail. FIG. 3 shows a state where the operation lever 5 is in the first rotation position. Although in this state, the spring 7 applies a force acting in a clockwise direction to the operation lever 5, the protrusion 5B makes contact with the edge of the first through hole 2B, and thus the operation lever 5 remains in the position. Then, in this state, the lock lever 6 is in the semi-locking position.

When the lock lever 6 is in the semi-locking position, since the lock lever 6 engages with the first engagement tooth row 11, as compared with the case where the lock lever 6 is in the cancellation state, the movement of the side regulation plate 2 is reduced. Here, the direction of the force applied by the spring 7 coincides with the rotation direction in which the lock lever 6 is pressed onto the engagement teeth. Hence, it is possible to realize more firm locking corresponding to the applied force.

Figure 6:
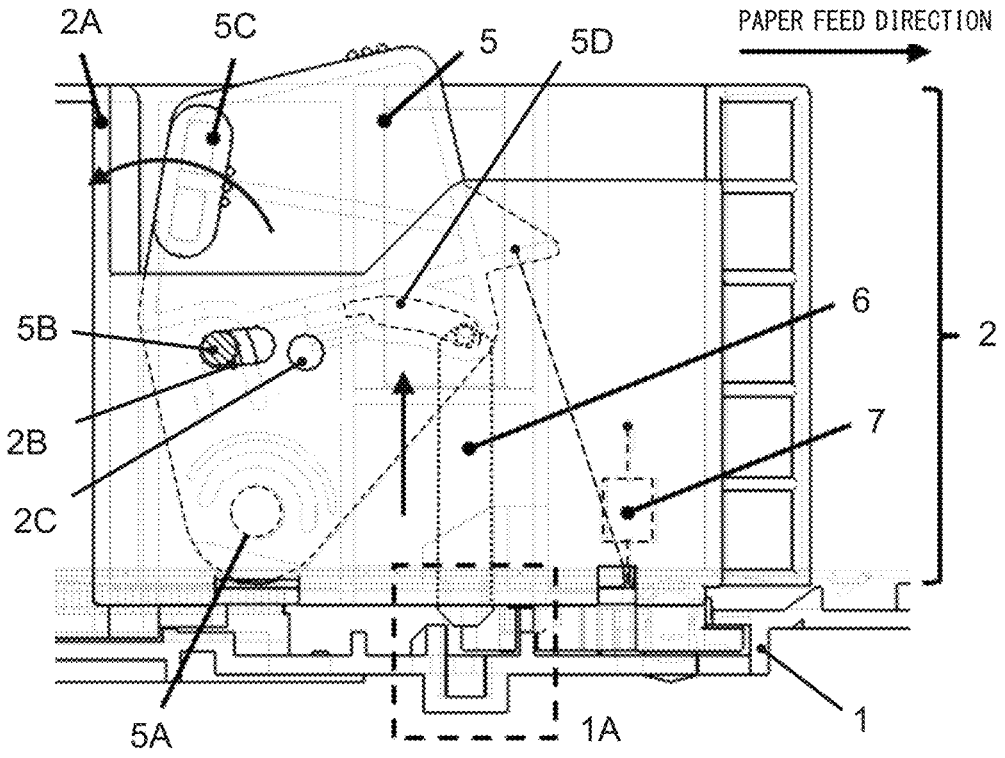
FIG. 6 An illustrative diagram of a state where an operation lever is in a second rotation position.

FIG. 6 shows a state where the operation lever 5 is in the second rotation position. When the user holds the operation portion 2A and the operation portion 5C so as to sandwich them and applies, to the operation lever 5, an operation force (rotating force in the anticlockwise direction) against the force applied by the spring 7, the operation lever 5 is rotated into the second rotation position. Although in this state, the operation lever 5 is pressed by the force of the user in the anticlockwise direction, the protrusion 5B makes contact with the edge of the first through hole 2B, and thus the operation lever 5 remains in the position.

Since in the state shown in FIG. 6, the lock lever 6 is in the cancellation position, and does not engage with any of the engagement tooth rows, the user can easily move the side regulation plate 2 in the side direction. Here, while the user is in the state where the user is operating the operation lever 5 (in the state where the user holds the operation portion 2A and the operation portion 5C so as to sandwich them), the user can continuously perform an operation of moving the side regulation plate 2 in the side direction (the direction of the width of the sheet). As described above, in the paper feed tray X, the side regulation plate 2 can be moved without the hand switching operation being performed, with the result that its operability is excellent.

When the user releases the hand in the state where the operation lever 5 is in the second rotation position, the operation lever 5 is returned to the first rotation position by the force applied by the spring 7. Hence, the operation lever 5 is naturally returned to the first rotation position without the intention of the user to return the operation lever 5 to the first rotation position. In this way, even when the user fails to perform a locking operation, the paper feed tray X is prevented from being fitted to the image forming apparatus main body with the lock lever 6 in the cancellation position.

Since the first engagement tooth row 11, which is formed higher than the second engagement tooth row 12, is arranged in a position closer to the rotation pivot 5A than the second engagement tooth row 12, the rotation path of the lock lever 6 is prevented from being inhibited. Since the first through hole 2B is present, the rotation of the operation lever 5 between the first rotation position and the second rotation position is not prevented by the protrusion 5B.

Figure 7:
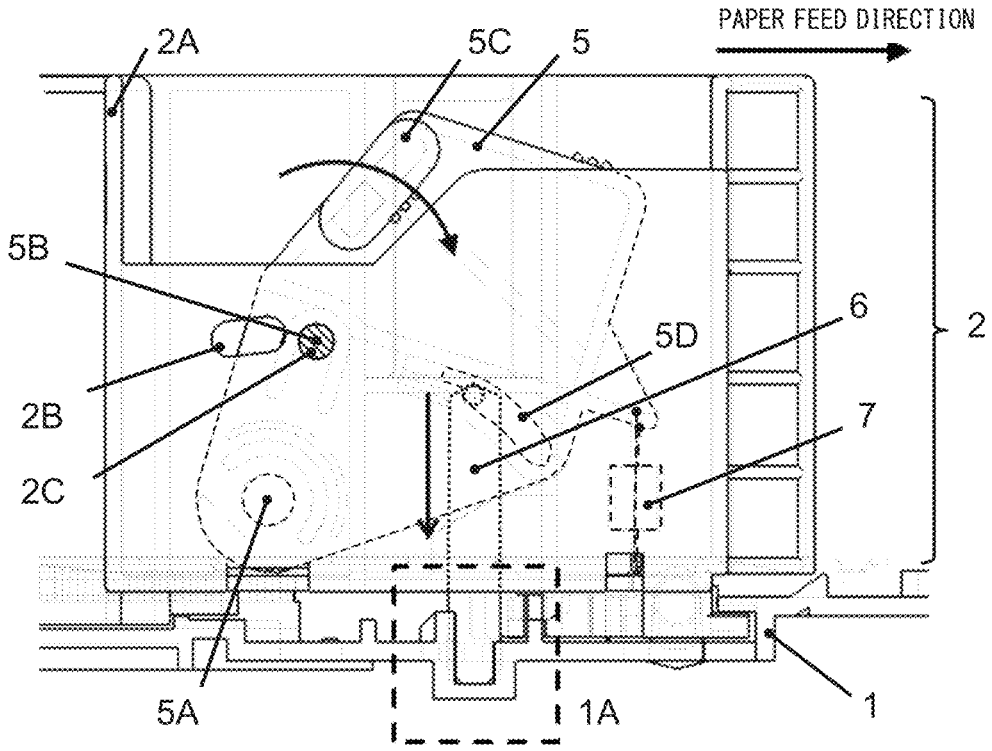
FIG. 7 An illustrative diagram of a state where the operation lever is in a third rotation position.

FIG. 7 shows a state where the operation lever 5 is in the third rotation position. When the operation force in the clockwise direction is applied by the user to the operation lever 5 with the operation lever 5 in the first rotation position, the protrusion 5B is pressed onto the edge of the first through hole 2B on the right side, undergoes elastic deformation so as to contract and rides over the first through hole 2B to fit into the second through hole 2C.

In this way, the operation lever 5 remains in the third rotation position. The length and the tip end shape of the protrusion 5B are preferably set such that the protrusion 5B can appropriately ride over the first through hole 2B by the operation force of the user. For example, the tip end shape of the protrusion 5B is preferably hemispherical.

In the state shown in FIG. 7, the lock lever 6 is in the locking position, and the lock lever 6 engages with both the engagement tooth rows 11 and 12. Hence, the lock lever 6 achieves a significant locking force such that the movement of the side regulation plate 2 in the side direction is firmly locked. In this way, even when the paper feed tray X is swiftly fitted by the user to the image forming apparatus main body, the position of the side regulation plate is prevented as much as possible from being displaced by the its shock.

As shown in FIG. 7, when the lock lever 6 is engaged with both the engagement tooth rows 11 and 12, since it is necessary to make the phases of the teeth coincide with each other, a pressing force by the operation of the user is needed. When in this state, the user applies the operation force in the anticlockwise direction to the operation lever 5, the protrusion 5B rides over the second through hole 2C and returns to the first through hole 2B, with the result that it is possible to return the operation lever 5 to the first rotation position.

As described above, the paper feed tray X according to the present embodiment includes the cassette 1 (the tray main body) which holds the sheet such that the sheet can be fed in the predetermined paper feed direction and the side regulation plate 2 which can be moved in the side direction perpendicular to the paper feed direction and which regulates the position of the held sheet in the side direction.

In the cassette 1, the first and second engagement tooth rows 11 and 12 whose engagement teeth are aligned in the side direction are provided so as to be opposite each other. In the side regulation plate 2, the lock lever 6 (engagement member) is provided that can be moved in the direction of the height of the engagement tooth rows 11 and 12 and that engages with the engagement tooth rows to reduce the movement of the side regulation plate 2 in the side direction. The first engagement tooth row 11 is higher than the second engagement tooth row 12.

Furthermore, as described previously, the lock lever 6 can be moved into the locking position, the cancellation position and the semi-locking position. Thus, it is possible to obtain firm locking by arranging the lock lever 6 in the locking position and to perform, for example, natural movement from the cancellation position to the semi-locking position to avoid a failure caused by failing to perform the locking operation.

With the paper feed tray X, an irregular-sized sheet can also be firmly locked, and thus the shock resistance when the cassette 1 is fitted is enhanced. Furthermore, with the paper feed tray X, a relatively small number of components can be used to achieve the configuration thereof, and thus the manufacturing cost can easily be lowered, and as described previously, without the hand switching operation being performed, the operation of moving the side regulation plate from the locking cancellation in the direction of the width of the sheet can be continuously performed.

The present invention is not limited at all to the embodiment described above, and various variations are possible without departing from its intention.

What is claimed is:

1. A paper feed tray comprising:

a tray main body which holds a sheet such that the sheet can be fed in a predetermined paper feed direction; and a regulation plate which can be moved in a side direction perpendicular to the paper feed direction and which regulates a position of the held sheet in the side direction, wherein in the tray main body, a first engagement tooth row and a second engagement tooth row whose engagement teeth are aligned in the side direction are provided so as to be opposite each other, in the regulation plate, an engagement member is provided which can be moved in a direction of height of the engagement tooth rows and which engages with the engagement tooth rows to reduce the movement of the regulation plate in the side direction, the engagement member being engagable with both of the first engagement tooth row and the second engagement tooth row, the first engagement tooth row is higher than the second engagement tooth row, and the engagement member can be moved into positions different from each other in the direction of height of the engagement tooth rows, the positions comprising:

a locking position in which the engagement member simultaneously engages with both the first engagement tooth row and the second engagement tooth row;

a cancellation position in which the engagement member engages neither with the first engagement tooth row nor the second engagement tooth row; and a semi-locking position in which the engagement member engages with the first engagement tooth row but does not engage with the second engagement tooth row.

2. The paper feed tray according to claim 1, wherein in the regulation plate, a rotation member supported such that the rotation member can be rotated about an axis which is the side direction is provided, the engagement member is formed so as to be moved in the direction of the height coordinately with the rotation of the rotation member and the rotation member can be rotated into:

a first rotation position in which a position of the engagement member is the semi-locking position;

a second rotation position in which the position of the engagement member is the cancellation position; and a third rotation position in which position of the engagement member is the locking position.

3. The paper feed tray according to claim 2, wherein a force acting in a direction from the second rotation position toward the first rotation position is applied to the rotation member.

4. The paper feed tray according to claim 2, wherein the rotation member includes a protrusion which protrudes toward the regulation plate and which has elasticity, the regulation plate includes a first hole which prevents interference with the protrusion when the rotation member is rotated between the first rotation position and the second rotation position and a second hole which prevents interference with the protrusion when the rotation member is in the third rotation position and the protrusion interferes with the regulation plate when the rotation member is rotated between the first rotation position and the third rotation position.

5. The paper feed tray according to claim 2, wherein the first engagement tooth row is arranged closer to a pivot of the rotation than the second engagement tooth row.

6. The paper feed tray according to claim 1, wherein the first engagement tooth row is part of a first rack and the second engagement tooth row is part of a second rack, a pinion is interposed between the first rack and the second rack to form a rack-and-pinion mechanism.

7. The paper feed tray according to claim 6, wherein the regulation plate is a first regulation plate connected to one of the first rack and the second rack, and a second regulation plate is connected to the other of the first rack and the second rack, so that when the first regulation plate is moved in the side direction, the second regulation plate is moved in an opposite direction by the same amount.

8. The paper feed tray according to claim 1, wherein a force acting in a direction from the cancellation position toward the semi-locking position is applied to the engagement member.

9. A paper feed tray comprising:

a tray main body which holds a sheet such that the sheet can be fed in a predetermined paper feed direction; and a regulation plate which can be moved in a side direction perpendicular to the paper feed direction and which regulates a position of the held sheet in the side direction, wherein in the tray main body, a first engagement tooth row and a second engagement tooth row whose engagement teeth are aligned in the side direction are provided so as to be opposite each other, in the regulation plate, an engagement member is provided which can be moved in a direction of height of the engagement tooth rows and which engages with the engagement tooth rows to reduce the movement of the regulation plate in the side direction, the engagement member being engagable with both of the first engagement tooth row and the second engagement tooth row, the first engagement tooth row is higher than the second engagement tooth row, and the first engagement tooth row is part of a first rack and the second engagement tooth row is part of a second rack, a pinion is interposed between the first rack and the second rack to form a rack-and-pinion mechanism.

10. The paper feed tray according to claim 9, wherein the regulation plate is a first regulation plate connected to one of the first rack and the second rack, and a second regulation plate is connected to the other of the first rack and the second rack, so that when the first regulation plate is moved in the side direction, the second regulation plate is moved in an opposite direction by the same amount.

11. A paper feed tray comprising:

a tray main body which holds a sheet and allows the sheet to be fed in a predetermined paper feed direction; and a regulation plate which is movable in a side direction perpendicular to the paper feed direction and which regulates a position of the held sheet in the side direction, wherein in the tray main body, a first engagement tooth row and a second engagement tooth row whose engagement teeth are aligned in the side direction are provided so as to be opposite each other, the first engagement tooth row being higher than the second engagement tooth row, in the regulation plate, an engagement member is provided movably in a direction of height of the engagement tooth rows and which engages with the engagement tooth rows to reduce the movement of the regulation plate in the side direction, and the engagement member is movable into positions different from each other in the direction of height of the engagement tooth rows, the positions comprising:

a first position in which the engagement member simultaneously engages with both the first engagement tooth row and the second engagement tooth row;

a second position in which the engagement member engages neither with the first engagement tooth row nor the second engagement tooth row; and a third position in which the engagement member engages with the first engagement tooth row is apart from the second engagement tooth row.

12. The paper feed tray according to claim 11, wherein a force acting in a direction from the second position toward the third position is applied to the engagement member.

* * * * *